US008210392B2

(12) United States Patent
Kang et al.

(10) Patent No.: US 8,210,392 B2
(45) Date of Patent: Jul. 3, 2012

(54) BEVERAGE CUP SLEEVE WITH INTEGRATED FOLD-OUT HANDLES

(76) Inventors: Ryan Kang, Porter Ranch, CA (US); Daniel Kang, Porter Ranch, CA (US)

( * ) Notice: Subject to any disclaimer, the term of this patent is extended or adjusted under 35 U.S.C. 154(b) by 185 days.

(21) Appl. No.: 12/512,885

(22) Filed: Jul. 30, 2009

(65) Prior Publication Data

US 2010/0213205 A1 Aug. 26, 2010

(51) Int. Cl.
*B65D 3/28* (2006.01)

(52) U.S. Cl. ..... 220/738; 220/737; 229/402

(58) Field of Classification Search ..... 220/737, 220/738, 739; 229/402, 403
See application file for complete search history.

(56) References Cited

U.S. PATENT DOCUMENTS

| | | | | | |
|---|---|---|---|---|---|
| 1,975,510 | A | * | 10/1934 | Hiatt | 217/3 FC |
| 2,558,287 | A | * | 6/1951 | Amberg | 229/402 |
| 2,641,403 | A | * | 6/1953 | Buttery et al. | 229/402 |
| 2,775,382 | A | * | 12/1956 | Kayat | 229/402 |
| 2,936,068 | A | * | 5/1960 | Munkachy | 220/737 |
| 2,965,281 | A | * | 12/1960 | Herrmann | 220/737 |
| 2,979,301 | A | * | 4/1961 | Reveal | 248/214 |
| 3,104,788 | A | * | 9/1963 | Wood | 294/152 |
| 4,685,583 | A | * | 8/1987 | Noon | 220/710.5 |
| 5,425,497 | A | * | 6/1995 | Sorensen | 220/738 |
| 5,579,950 | A | * | 12/1996 | Yamanaka | 220/752 |
| 5,746,372 | A | * | 5/1998 | Spence | 229/403 |
| 5,857,615 | A | * | 1/1999 | Rose | 229/403 |
| 5,868,310 | A | * | 2/1999 | Leszczynski | 229/402 |
| 6,116,503 | A | * | 9/2000 | Varano | 229/403 |
| 6,152,363 | A | * | 11/2000 | Rule, Jr. | 229/403 |
| 6,260,756 | B1 | * | 7/2001 | Mochizuki et al. | 229/402 |
| 6,273,333 | B1 | * | 8/2001 | Ward | 229/402 |
| 6,286,754 | B1 | * | 9/2001 | Stier et al. | 229/403 |
| D449,961 | S | * | 11/2001 | Miura | D7/507 |
| 6,315,192 | B1 | * | 11/2001 | Marlow | 229/401 |
| 6,343,735 | B1 | * | 2/2002 | Cai | 229/117.23 |
| 6,557,751 | B2 | * | 5/2003 | Puerini | 229/402 |
| 7,704,347 | B2 | * | 4/2010 | Hollis et al. | 156/277 |
| 7,767,049 | B2 | * | 8/2010 | Sadlier | 156/205 |
| 7,918,364 | B2 | * | 4/2011 | Kim et al. | 220/738 |
| 7,922,031 | B1 | * | 4/2011 | Prince | 220/739 |
| 2002/0148888 | A1 | * | 10/2002 | Kim | 229/402 |
| 2003/0071045 | A1 | * | 4/2003 | Taylor | 220/737 |
| 2010/0224641 | A1 | * | 9/2010 | Hanel | 220/737 |

* cited by examiner

*Primary Examiner* — Anthony Stashick
*Assistant Examiner* — Christopher McKinley

(57) ABSTRACT

A beverage cup sleeve configured to provide multiple grip handles and additional layering for thermal buffering through reconfigurable handles. The sleeve includes a first and a second web portion corresponding to a first and a second cavity portion provided at the outer side, respectively, and a first and a second notch provided next the first and the second cavity portions, respectively, thereby providing the additional layering when either the first or the second notch fastens the corresponding web portion selected to fold out. Additionally, the strip includes a third and a fourth web portion corresponding to a third and a fourth cavity portion provided at the outer side, respectively, and a third and a fourth notch provided next to the third and the fourth cavity portions, respectively, thereby providing additional layering when either the third or the fourth notch fastens the corresponding web portion selected to fold out.

14 Claims, 3 Drawing Sheets

BEVERAGE CUP SLEEVE WITH INTEGRATED FOLD-OUT HANDLES

FIELD OF THE DISCLOSURE

Embodiments of the invention relate generally to beverage containers, and more particularly beverage cup sleeves.

BACKGROUND

Insulating holders for beverage containers serve the purpose of keeping a consumer's hand free from excessive heat dispersing from a liquid beverage. An increasing number of beverage cup sleeves have been distributed by retailers serving hot beverages to consumers.

Conventional beverage cup sleeves have been made of a lightweight, thin material, such as polystyrene or wax paper. Additionally, beverage cup sleeves have generally been constructed with corrugated paper for thermal buffering. Further, beverage cup sleeves have generally been constructed using a single layer of material.

Thus, it is desirable to have a beverage cup sleeve with increasing thermal insulation between a consumer's hand and the excessive heat dispersing from a liquid beverage while increasing the grip of the beverage container without the limitations of conventional techniques.

SUMMARY

In accordance with an embodiment of the present invention, it is contemplated that a beverage cup sleeve has an elongated strip of material configured to provide multiple grip handles and additional layering for thermal buffering through reconfigurable handles. The elongated strip of material has a first end and a second end, including an inner side and an outer side. The strip further has a top edge having a convex shape and a bottom edge having a concave shape, such that the elongated strip is folded to connect the first end to the second end thereby shaping the top edge and the bottom edge to receive a beverage container at the inner side with a snug fit. For the additional layering, the strip includes a first and a second web portion corresponding to a first and a second cavity portion provided at the outer side, respectively, and a first and a second notch provided next the first and the second cavity portions, respectively, thereby providing the additional layering when either the first or the second notch fastens the corresponding web portion selected to fold out. Additionally, the strip includes a third and a fourth web portion corresponding to a third and a fourth cavity portion provided at the outer side, respectively, and a third and a fourth notch provided next the third and the fourth cavity portions, respectively, thereby providing additional layering when either the third or the fourth notch fastens the corresponding web portion selected to fold out. Accordingly, the third the fourth web portions are opposite from the first and the second web portions to optionally provide a dual handle grip of the beverage cup sleeve. Furthermore, each of the web portions has perforations substantially around thereby allowing each of the web portions to be cut out at the perforations and provide a grip handle for the beverage cup sleeve when each of the web portions are extended toward each other.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The invention and its various embodiments are more fully appreciated in connection with the following detailed description taken in conjunction with the accompanying drawings, in which.

Like reference numerals refer to corresponding parts throughout the several views of the drawings. Note that most of the reference numerals include one or two left-most digits that generally identify the figure that first introduces that reference number.

DETAILED DESCRIPTION OF THE PREFERRED EMBODIMENTS

A detailed description of one or more embodiments is provided below along with accompanying figures that illustrate the principles of the embodiments. The scope of the embodiments is limited only by the claims and encompasses numerous alternatives, modifications and equivalents. Numerous specific details are set forth in the following description. These details are provided solely for the purposes of example and the embodiments may be practiced according to the claims without some or all of these specific details.

Figure 1A:
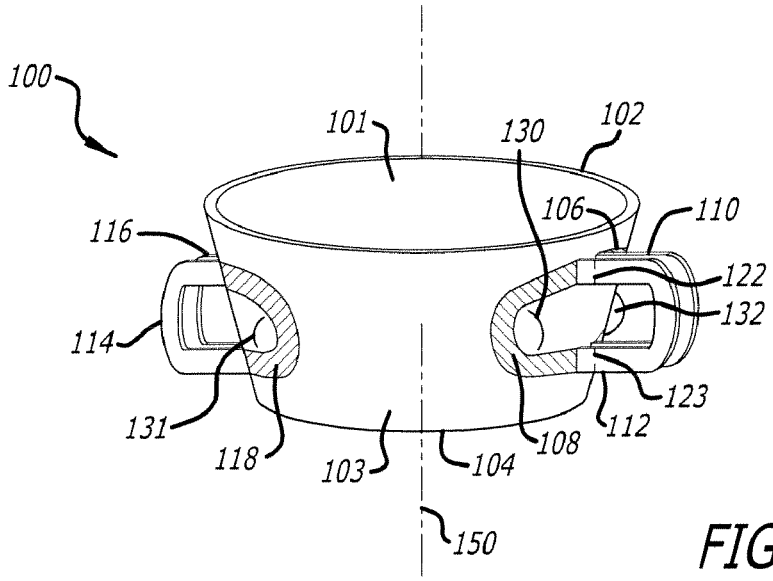
FIG. 1A is a perspective view of an exemplary beverage cup sleeve having dual fold-out handles in accordance with an embodiment of the present disclosure.

Referring to the drawings and in particular to FIG. 1A, beverage cup sleeves having fold-out handles in accordance with a preferred embodiment of the present disclosure is described.

The beverage cup sleeve 100 is made of an elongated strip of material, which is folded to engage opposite ends of the strip thereby configuring the elongated strip to receive a beverage container (not shown) with a snug fit around the curvature of the beverage container.

Referring to FIG. 1A, a perspective view of an exemplary beverage cup sleeve having dual fold-out handles in accordance with an embodiment of the present disclosure is described. In FIG. 1A, the beverage cup sleeve 100 includes handle cavity portions 106, 108, 116, 118 and fold-out handles 110, 112, 114, 116. The beverage cup sleeve 100 has an inner side 101 and an outer side 103 including a top edge 102 having a convex shape and a bottom edge 104 having a concave shape. In the starting position, the fold-out handles 110, 112, 114, 116 are contained in the handle cavity portions 106, 108, 116, 118 respectively, which are provided at the outer side 103.

In some embodiments, the handle cavity portions 106, 108, 116, 118 can have perforations substantially around the corresponding fold-out handle, thereby allowing each fold-out handle to be cut out and folded at predetermined fold lines (e.g., fold lines 122, 123) for added convenience.

The fold-out handles can be extended outward toward each other relative to a reference line 150 from the starting position to an ending position thereby providing grip handles at opposite ends of the beverage cup sleeve 100.

Each fold-out handle of the beverage cup sleeve 100 can return to the starting position and fit snugly with the corresponding handle cavity portion of the sleeve.

In a preferred embodiment, notches are provided next to the cavity portions of the corresponding fold-out handles thereby providing additional layering to increase thermal buffering when one of the notches fastens the corresponding fold-out handle folded over and resting against the nearest handle and the outer side 103. In some embodiments, the notches can have a rounded edge or a pointed edge. Examples of the operation of the preferred embodiment will be shown in FIG. 1B.

It is contemplated that the beverage cup sleeve provides benefits, such as increasing thermal insulation between a consumer's hand and the excessive heat dispersing from a liquid beverage by providing additional layering when fastening a fold-out handle over an adjacent fold-out handle into a notch. Alternatively, the beverage cup sleeve provides multiple handling configurations, such as a single or dual handle grip depending on the handling ability of a user. For example, configuring the beverage cup sleeve to have dual handles can benefit a young or an elderly user who may require two handles to grip the sleeve containing a cup since handling a cup with only a single handle may be difficult. Various implementations may be used and the beverage cup sleeve with fold-out handle configurations are not limited to those embodiments described above.

Figure 1B:
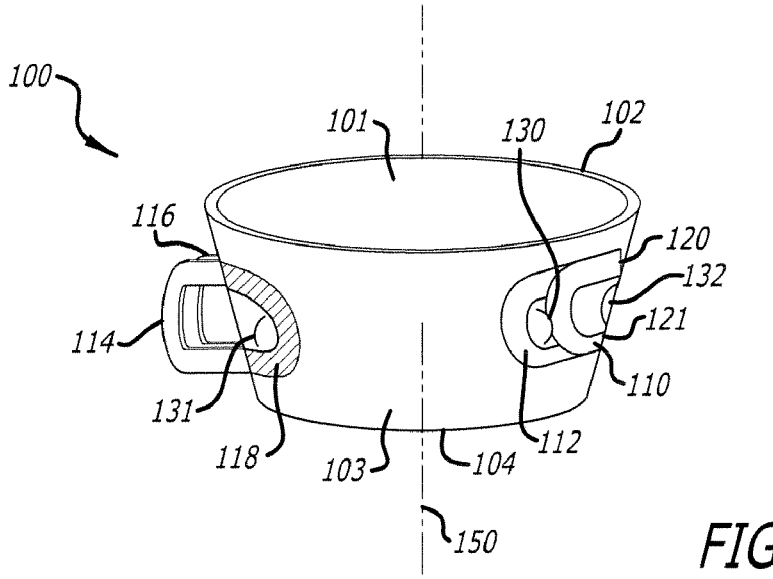
FIG. 1B is a perspective view of another exemplary beverage cup sleeve having dual fold-out handles as illustrated in FIG. 1A in accordance with an embodiment of the present disclosure.

Referring to FIG. 1B, a top view of the beverage cup sleeve 100 illustrating dual fold-out handles as illustrated in FIG. 1A in accordance with an embodiment of the present disclosure is provided. Each pair of fold-out handles (e.g., fold-out handles 114, 116) fold out from the respective handle cavity portion toward each other relative to the reference line 150.

Here, the beverage cup sleeve 100 has the fold-out handle 112 folded over the fold-out handle 110 and fastened by the notch 130 thereby providing additional layering to increase the thermal buffering of the beverage cup sleeve 100 when a user handles the sleeve at the fold-out handle 112. Additionally, either the fold-out handle 116 can fold over and fastened by the notch 131 thereby providing a dual grip of the beverage cup sleeve 100 while providing additional layering to increase the thermal buffering of the beverage cup sleeve 100. Alternatively, the fold-out handles 110 and 114 can provide similar configurations and benefits.

Figure 1C:
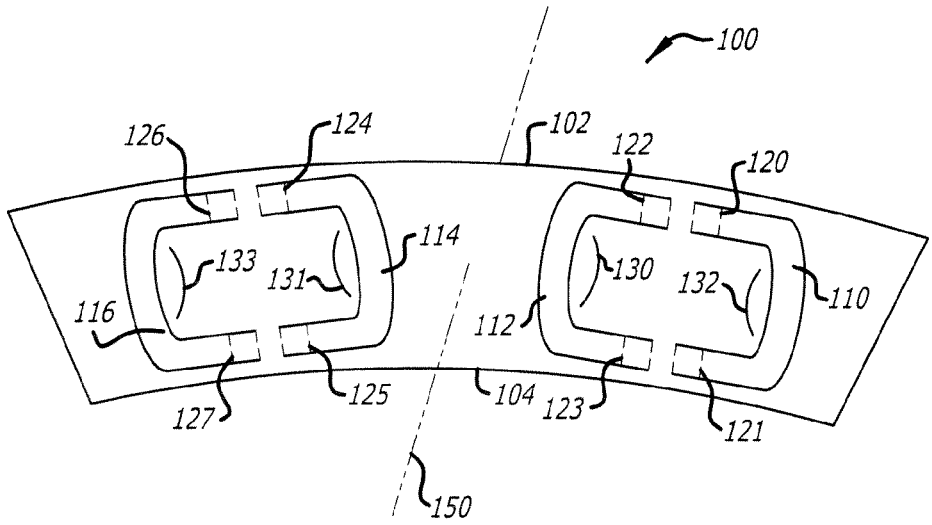
FIG. 1C is a panoramic view of the exemplary beverage cup sleeve having dual fold-out handles as illustrated in FIG. 1A in accordance with an embodiment of the present disclosure.

Referring to FIG. 1C, a panoramic view of the exemplary beverage cup sleeve having dual fold-out handles as illustrated in FIG. 1A in accordance with an embodiment of the present disclosure is described. Here, the beverage cup sleeve 100 provides notches 130, 131, 132, 133 to fasten a folded-over handle thereby providing additional layering to increase thermal buffering. For example, fold-out handle 110 can be folded over and fastened by the notch 130 thereby providing additional layering at where the fold-out handle 110 and the fold-out handle 112 meet. Similar configurations can be provided by the fold-out handles 112, 114 and 116 when engaging the notches 131, 132, and 133 accordingly.

In some embodiments, the fold-out handles 110 and 116 can be folded at predetermined fold lines (e.g., fold lines 120, 121, 126, 127). The fold lines allow each of the fold-out handles to be folded for proper fastening by the corresponding notch.

In other embodiments, the notches 130, 131, 132, 133 can have a rounded shape as shown in FIG. 1C. In still other embodiments, the notches 130, 131, 132, 133 can have a pointed edge.

As shown, each end of the elongated strip of material, forming the beverage cup sleeve 100 when folded at each end, provides pairs of fold-out handles in mirror positions of each other. The convex shape of the top edge 102 and the concave shape of the bottom edge 104 provides for a snug fit of a beverage cup.

The fold-out handles 110, 112, 114, 116 can have varying shapes for an opening as long as the shape allows for a snug fit of a user's finger thereby providing a sturdy and rigid grip of the beverage cup sleeve 100.

Each pair of fold-out handles (e.g., 110, 112) can be cut out from the perforations provided substantially around each handle and fold out relative to the reference line 150. Various implementations may be used and the beverage cup sleeve with fold-out handle configurations are not limited to those embodiments described above.

Figure 1D:
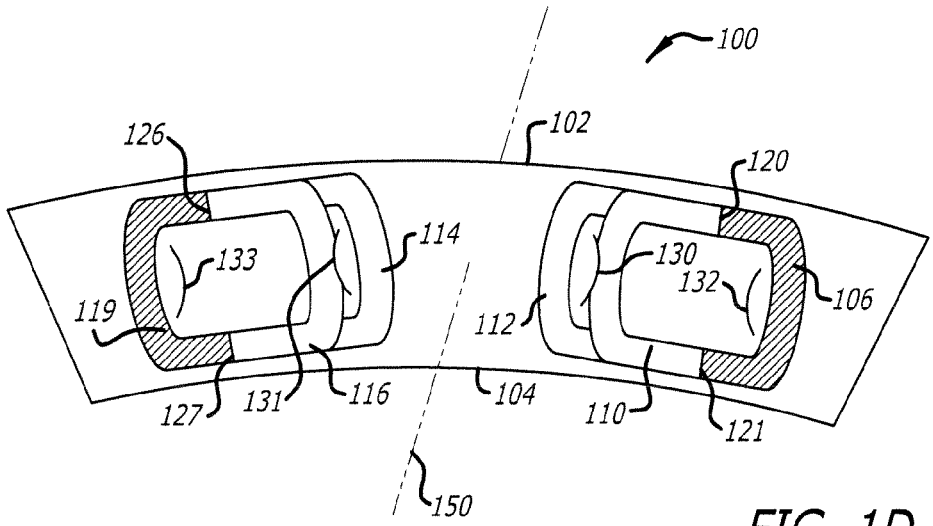
FIG. 1D is a panoramic view of another exemplary beverage cup sleeve having dual fold-out handles as illustrated in FIG. 1C in accordance with an embodiment of the present disclosure.

Referring to FIG. 1D, a panoramic view of another exemplary beverage cup sleeve having dual fold-out handles as illustrated in FIG. 1C in accordance with an embodiment of the present disclosure is described. Here, fold-out handles 110 and 116 are folded over the nearest fold-out handles 112, 114, respectively. Additionally, the fold-out handles 110 and 116 are folded at predetermined fold lines 120, 121, 126, 127. The fold-out handles 110 and 116 are fastened by notches 130 and 131, respectively. Accordingly, a user handling the beverage cup sleeve 100 at the handles 116 and 110 can receive increased thermal buffering through the additional layering created when the fold-out handles 110 and 116 are folded over the fold-out handles 112 and 114, respectively. Various implementations may be used and the beverage cup sleeve with fold-out handle configurations are not limited to those embodiments described above.

Figure 1E:
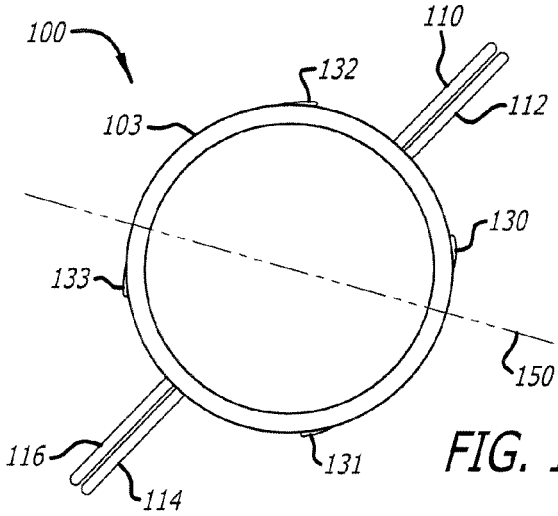
FIG. 1E is a top view of an exemplary beverage cup sleeve having dual fold-out handles as illustrated in FIG. 1A in accordance with an embodiment of the present disclosure.

FIG. 1E is a top view of an exemplary beverage cup sleeve having dual fold-out handles as illustrated in FIG. 1A in accordance with an embodiment of the present disclosure. Here, notches 130, 131, 132, 133 are configured to engage 110, 116, 112, 114, respectively. Each fold-out handle can fold out from a corresponding handle cavity portion and fold over towards a corresponding notch to be fastened in place. Accordingly, the folded and fastened fold-out handle provides additionally layering in conjunction with the beverage cup sleeve to increase the thermal buffering between excessive heat dispersing from a received beverage cup and the outer side 103.

Figure 2A:
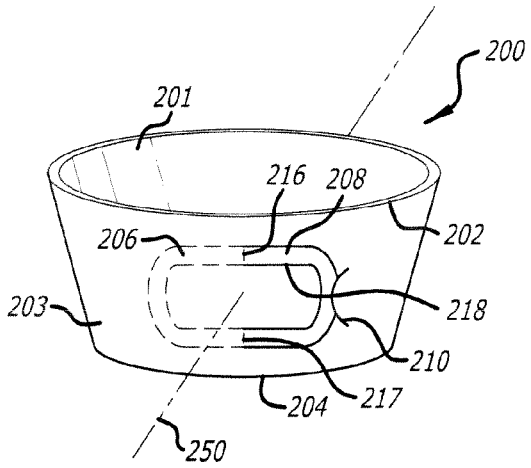
FIG. 2A is a perspective view of an exemplary beverage cup sleeve having a fold-out handle engaging a notch in accordance with an embodiment of the present disclosure.

FIG. 2A is a perspective view of an exemplary beverage cup sleeve having a fold-out handle engaging a notch in accordance with an embodiment of the present disclosure. Here, the beverage container sleeve 200 includes a handle cavity portion 206, a fold-out handle 208, and a notch 210.

The fold-out handle 208 having an opening 218 of a shape providing a snug fit for a user's finger can be cut out at the perforations and fold over at the predetermined fold lines 216, 217 towards the notch 210. The notch 210 can be a slit in the material of the beverage cup sleeve 200 to provide a fastening means for the fold-out handle 208. The ending position of the fold-out handle, as shown in FIG. 2A, provides additional layering for increased thermal buffering of the beverage cup sleeve 200.

In some embodiments, the opening 218 can be perforated substantially around thereby providing a user the option to cut out the opening 218. The web portion of the beverage cup sleeve 200 configured as the fold-out handle 208 can be left intact (i.e., opening 218 can be left uncut at the perforations), thereby allowing the user to handle the beverage cup sleeve 200 at the fold-out handle 208 when folded over from the handle cavity portion 206 and fastened at the notch 210. In other embodiments, the opening 218 can take many shapes (e.g., round, square) so to receive at least a finger of a user and provide a snug fit around the finger thereby increasing the grip of the beverage cup sleeve 200.

A second fold-out handle (not shown) can be provided at an opposite side of the beverage cup sleeve 200 relative to the fold-out handle 208 for increasing handling of the beverage cup sleeve 200 when receiving additional thermal buffering from the additional layering created. Various implementations may be used and the beverage cup sleeve with fold-out handle configurations are not limited to those embodiments described above.

Figure 2B:
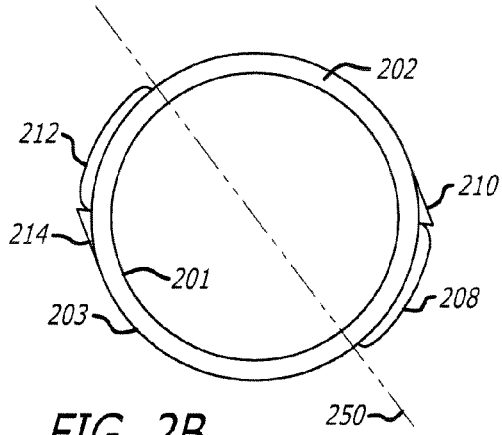
FIG. 2B is a top view of an exemplary beverage cup sleeve having dual fold-out handles each engaging a corresponding notch as illustrated in FIG. 2A in accordance with an embodiment of the present disclosure.

Referring to FIG. 2B, a top view of the beverage cup sleeve 200 having dual fold-out handles where each fold-out handle engages a notch for fastening in accordance with an embodiment of the present disclosure is provided. Here, notches 210, 212 engage fold-out handles 208, 212 respectively. Each fold-out handle can fold out from a corresponding handle cavity portion and fold over towards a corresponding notch to be fastened. For example, the fold-out handle 208 folds away from the reference line 250 to be fastened by the notch 210. As shown in FIG. 2B, additional layering is created when the fold-out handles 208, 212 are resting against the outer side 203 of the beverage cup sleeve 200. As a result, thermal buffering between a user's grip and the beverage cup sleeve 200 is increased, thereby providing additional comfort for the user when handling a beverage cup dispersing excessive heat.

It is contemplated that the beverage cup sleeve benefits a consumer by increasing thermal insulation between the consumer's hand and the excessive heat dispersing from a liquid beverage by providing additional layering in conjunction with the beverage cup sleeve 200 when fastening a fold-out handle into a notch that is folded over an adjacent fold-out handle. Alternatively, the beverage cup sleeve provides multiple handle configurations, such as a single or dual handle grip depending on the handling ability of the consumer. For example, configuring the beverage cup sleeve to have dual handles can benefit a young or an elderly consumer who may require two handles to grip the sleeve since handling a cup with only a single-handle sleeve may be difficult.

The features described in the abstract, the patent claims, the description and those aspects presented in the drawings can prove essential both singly and in arbitrary combinations to the realization of the disclosure.

While specific embodiments of the invention have been shown and described in detail to illustrate the application of the principles of the invention, it will be understood that the invention may be embodied otherwise without departing from such principles.

Thus, the foregoing descriptions of specific embodiments of the invention are presented for purposes of illustration and description. They are not intended to be exhaustive or to limit the invention to the precise forms disclosed; many alternatives, modifications, equivalents, and variations are possible in view of the above teachings. For the purpose of clarity, technical material that is known in the technical fields related to the embodiments has not been described in detail to avoid unnecessarily obscuring the description. Thus, the various embodiments can be modified within the scope and equivalents of the appended claims. Further, the embodiments were chosen and described in order to best explain the principles of the invention and its practical applications: they thereby enable others skilled in the art to best utilize the disclosure and various embodiments with various modifications as are suited to the particular use contemplated. Notably, not every benefit described herein need be realized by each embodiment of the present invention; rather any specific embodiment can provide one or more of the advantages discussed above. In the claims, elements and/or operations do not imply any particular order of operation, unless explicitly stated in the claims. It is intended that the following claims and equivalents define the preferred embodiments of the invention.

What is claimed:

1. A beverage cup sleeve, comprising:

an elongated strip of material comprising:

a first end and a second end;

an inner side and an outer side;

a top edge having a convex shape and a bottom edge having a concave shape, the elongated strip folded to connect the first end to the second end in order to shape the top edge and the bottom edge to receive a beverage container at the inner side with a snug fit;

a first and a second web portion corresponding to a first and a second cavity portion provided at the outer side, respectively;

a first and a second notch, configured to fasten a corresponding one of the first and second web portions selected to fold out, and provided adjacent to the first and the second cavity portions, respectively, in order to provide additional layering when either the first or the second notch fastens the corresponding one of the first and second web portions selected to fold out; and a third and a fourth web portion corresponding to a third and a fourth cavity portion provided at the outer side, respectively, and defined within the outer side such that the third the fourth web portions are opposite from the first and the second web portions to provide a dual handle grip of the beverage cup sleeve when the first, second, third, and fourth web portions are folded out;

a third and a fourth notch configured to fasten a corresponding one of the third and fourth web portions selected to fold out, and provided adjacent to the third and the fourth cavity portions, respectively, thereby providing additional layering when either the third or the fourth notch fastens the corresponding one of the third and fourth web portions to fold out, wherein each notch is defined within the outer side such that each notch is parallel with a plane of an outer surface of the received beverage container, and wherein each web portion has perforations for allowing each web portion to be folded out from the perforations to provide a grip handle for the beverage cup sleeve when a corresponding pair of the first and second or third and fourth web portions is extended toward each other.

2. The beverage cup sleeve of claim 1, wherein each notch has a rounded edge.

3. The beverage cup sleeve of claim 1, wherein each notch has a pointed edge.

4. The beverage cup sleeve of claim 1, wherein each web portion has a predetermined fold line separate from the perforations in order to allow each web portion to fold out at the predetermined fold line.

5. The beverage cup sleeve of claim 1, wherein each web portion has an opening to receive at least a finger of a user.

6. The beverage cup sleeve of claim 1, wherein each web portion can fit snug into place when returning to the corresponding cavity portion.

7. A beverage cup sleeve, comprising:

an elongated strip of material comprising:

a first end and a second end;

an inner side and an outer side;

a top edge having a convex shape and a bottom edge having a concave shape, the elongated strip folded to connect the first end to the second end in order to shape the top edge and the bottom edge to receive a beverage container at the inner side with a snug fit;

a first and a second web portion corresponding to a first and a second cavity portion provided at the outer side, respectively;

a first and a second notch, configured to fasten a corresponding one of the first and second web portions selected to fold out, and provided adjacent the first and second cavity portions, respectively, in order to provide additional layering when either the first or the second notch fastens the corresponding one of the first and second web portions selected to fold out; and a third and a fourth web portion corresponding to a third and a fourth cavity portion provided at the outer side, respectively;

a third and a fourth notch configured to fasten a corresponding one of the third and fourth web portions selected to fold out, and provided adjacent to the third and the fourth cavity portions, respectively, in order to provide additional layering when either the third or the fourth notch fastens the corresponding one of the third and fourth web portions selected to fold out, wherein each notch is defined within the outer side such that each notch is parallel with a plane of an outer surface of the received beverage container.

8. The beverage cup sleeve of claim 7, wherein each notch has a rounded edge.

9. The beverage cup sleeve of claim 7, wherein each notch has a pointed edge.

10. The beverage cup sleeve of claim 7, wherein each web portion has a predetermined fold line separate from the perforations and thereby allowing each web portion to fold out at the predetermined fold line.

11. The beverage cup sleeve of claim 7, wherein each web portion has an opening to receive at least a finger of a user.

12. The beverage cup sleeve of claim 7, wherein each web portion can fit snug into place when returning to the corresponding cavity portion.

13. The beverage cup sleeve of claim 7, wherein the third web portion and the fourth web portion are defined within the outer side such that the third the fourth web portions are opposite from the first and the second web portions to provide a dual handle grip of the beverage cup sleeve when the first, second, third, and fourth web portions are folded out.

14. The beverage cup sleeve of claim 7, wherein each web portion has perforations for allowing each web portion to be folded out from the perforations to provide a grip handle for the beverage cup sleeve when a corresponding pair of the first and second or third and fourth web portions is extended toward each other.

* * * * *